US009870735B2

(12) United States Patent
Lim et al.

(10) Patent No.: US 9,870,735 B2
(45) Date of Patent: Jan. 16, 2018

(54) DISPLAY DEVICE INCLUDING DOUBLE-GATE TRANSISTORS WITH REDUCED DETERIORATION

(71) Applicant: SAMSUNG DISPLAY CO., LTD., Yongin-si, Gyeonggi-do (KR)

(72) Inventors: Ji Hun Lim, Goyang-si (KR); Yeon Keon Moon, Seoul (KR); Masataka Kano, Hwaseong-si (KR); Jun Hyung Lim, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 71 days.

(21) Appl. No.: 14/926,922

(22) Filed: Oct. 29, 2015

(65) Prior Publication Data

US 2016/0300526 A1 Oct. 13, 2016

(30) Foreign Application Priority Data

Apr. 7, 2015 (KR) ..... 10-2015-0049148

(51) Int. Cl.
*G09G 3/36* (2006.01)
*G09G 3/3233* (2016.01)

(52) U.S. Cl.
CPC ... *G09G 3/3233* (2013.01); *G09G 2300/0842* (2013.01); *G09G 2320/043* (2013.01)

(58) Field of Classification Search
CPC ..... G09G 3/12–3/14; G09G 3/30–3/3291
See application file for complete search history.

(56) References Cited

U.S. PATENT DOCUMENTS

2006/0066512 A1* 3/2006 Afentakis ..... G09G 3/20 345/55
2012/0007084 A1 1/2012 Park et al.
2013/0021316 A1* 1/2013 Inoue ..... G09G 3/3233 345/212
2013/0027369 A1* 1/2013 Minami ..... G09G 3/3233 345/204
2013/0157399 A1 6/2013 Park et al.

FOREIGN PATENT DOCUMENTS

KR 1020060051459 5/2006
KR 1020120030379 3/2012
KR 1020140035156 3/2014

* cited by examiner

*Primary Examiner* — Sanghyuk Park
(74) *Attorney, Agent, or Firm* — F. Chau & Associates, LLC

(57) ABSTRACT

A display device includes: a plurality of pixels, wherein each of the plurality of pixels includes at least two double-gate transistors including a first gate electrode and a second gate electrode; conduction between source electrodes and drain electrodes of the at least two double-gate transistors is controlled by a voltage applied to the first gate electrode, and electrical connection between the second gate electrode and the first gate electrode of each of the at least two double-gate transistors is determined depending on a polarity of a voltage applied on average to each of the at least two double-gate transistors.

15 Claims, 8 Drawing Sheets

DISPLAY DEVICE INCLUDING DOUBLE-GATE TRANSISTORS WITH REDUCED DETERIORATION

CROSS-REFERENCE TO RELATED APPLICATION

This application claims priority to and the benefit of Korean Patent Application No. 10-2015-0049148 filed in the Korean Intellectual Property Office on Apr. 7, 2015, the entire contents of which are incorporated by reference herein.

TECHNICAL FIELD

The present invention relates to a display device.

DISCUSSION OF RELATED ART

An example of a display device includes a liquid crystal display, an organic light emitting display, and the like. To electrically control driving of the display device, a plurality of thin film transistors (TFTs) may be needed per pixel.

However, thin film transistors deteriorate due to stress caused by bias voltage, temperature, light source, and the like continuously applied thereto.

Threshold voltages of the deteriorated thin film transistors are moved, and various characteristics become erratic. Furthermore, a thin film transistor with a deteriorated threshold voltage may have a driving defect, a display defect, and the like.

SUMMARY

An exemplary embodiment of the present invention provides a display device including a plurality of pixels, wherein each of the plurality of pixels includes at least two double-gate transistors. Each double-gate transistor including a first gate electrode and a second gate electrode. Each double-gate transistor is configured to conduct a current between the source and the drain electrode when a voltage is applied to the first gate electrode. A type of electrical connection between the first gate electrode and the second gate electrode of each of the at least two double-gate transistors are selected depending on a polarity of a voltage applied on average to each of the at least two double-gate transistors.

The polarity of the voltage applied on average to each of the at least two double-gate transistors may be a polarity of a voltage applied during a light emitting period in which a light emitting unit of each of the plurality of pixels emits light.

The polarity of the voltage applied on average to each of the at least two double-gate transistors may be a polarity of a voltage applied on average to the first gate electrode of each of the at least two double-gate transistors.

The polarity of the voltage applied on average to each of the at least two double-gate transistors may be calculated by a difference between a voltage applied on average to the first gate electrode of each of the at least two double-gate transistors and a voltage applied on average to the source electrode when the at least two double-gate transistors are N-channel transistors.

A type of electrical connection of the second gate electrode may be a first connection that is floated or a second connection may be connected to have the same voltage as that of the first gate electrode.

The type of electrical connection of the second gate electrode may be the first connection when the polarity of the voltage applied on average to each of the at least two double-gate transistors is a positive polarity. The type of electrical connection of the second gate electrode may be the second connection when the polarity of the voltage applied on average to each of the at least two double-gate transistors is a negative polarity.

The first gate electrode may be a top gate electrode, and the second gate electrode may be a bottom gate electrode.

The display device may further include a data driver supplying a corresponding data voltage to each of the plurality of pixels. A scan driver supplying a corresponding scan voltage to each of the plurality of pixels. The display device may further include a switching transistor having the scan voltage applied to the first gate electrode thereof and the data voltage applied to the drain electrode thereof is the second component. The display device may further include a driving transistor having a voltage applied to the first gate electrode thereof and corresponding to the data voltage is the first component.

The display device may further include: an emission controller supplying a corresponding light emission control signal to each of the plurality of pixels. A light emission control transistor having the light emission control signal applied to the first gate electrode thereof and having a first power supply connected to one end thereof is the first component.

A display device including a plurality of pixels may include at least a first transistor and a second transistor. The first transistor and the second transistor may be connected in series between a first power supply voltage and an organic light emitting diode OLED. The first transistor is a double-gate transistor and the second transistor is a double-gate transistors. A first gate electrode of the first transistor is connected to a light emission control signal line. A first gate electrode of the second transistor is connected to a third transistor and a capacitor. A second gate electrode of the first transistor is floated and a second gate electrode of the second transistor is floated.

An electrical connection between the first gate electrode and the second gate electrode of each of the at least two double-gate transistors in each pixel may be calculated to depend on a polarity of a voltage applied on average to each of the at least two double-gate transistors.

Each pixel includes a third transistor. The third transistor is a double-gate transistor; and one end of the third transistor is electrically connected to a data line and a first gate of the third transistor is electrically connected to a scan line and the second gate of the third transistor is also electrically connected to the scan line.

The first gate electrode may a top gate electrode, and the second gate electrode may be a bottom gate electrode of each double-gate transistor.

A data driver may supply a corresponding data voltage to each of the plurality of pixels. A scan driver may supply a corresponding scan voltage to each of the plurality of pixels. A switching transistor may have the scan voltage applied to the first gate electrode thereof and the data voltage applied to the drain electrode thereof may be in a second connection. A driving transistor may have a voltage applied to the first gate electrode thereof and corresponding to the data voltage may be in a first connection.

An emission controller may supply a corresponding light emission control signal to each of the plurality of pixels. A light emission control transistor having the light emission control signal applied to the first gate electrode thereof and having a first power supply connected to one end thereof is in the first connection.

A kind of transistor for use in each pixel may be selected depending on whether a bias stress type is positive or negative.

To ascertain whether the bias stress is the positive or the negative, a difference Vds between a drain voltage and a source voltage and a difference Vgs between a gate voltage and the source voltage are considered.

To ascertain whether the bias stress is positive or negative the polarity of a voltage applied on average to the gate electrodes of each transistor are considered.

According to an exemplary embodiment of the present invention, a display device including a thin film transistor selected depending on a stress environment may be provided.

DETAILED DESCRIPTION

Figure 1:
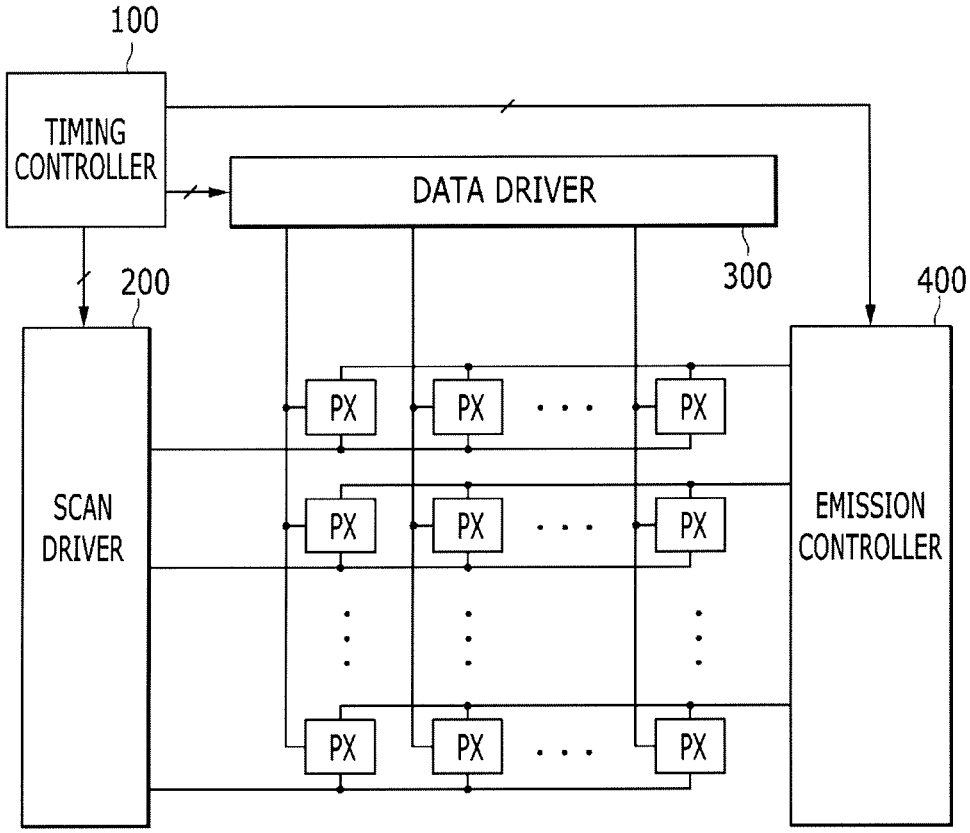
FIG. 1 is a view of a display device according to an exemplary embodiment of the present invention.

Hereinafter, exemplary embodiments of the present invention will be described more fully with reference to the accompanying drawings so as to be easily practiced by those skilled in the art to which the present invention pertains. As those skilled in the art would realize, the described embodiments may be modified in various different ways, all without departing from the spirit or scope of the present invention.

In the drawings, the thickness of layers, films, panels, etc., are exaggerated for clarity. Like reference numerals designate like elements throughout the specification. It will be understood that when an element such as a layer, film, or substrate is referred to as being "on" another element, it can be directly on the other element or intervening elements may also be present. In contrast, when an element is referred to as being "directly on" another element, there are no intervening elements present.

FIG. 1 is a view showing a display device according to an exemplary embodiment of the present invention.

The display device according to an exemplary embodiment of the present invention includes a timing controller 100, a scan driver 200, a data driver 300, an emission controller 400, and a plurality of pixels PXs.

However, although the present exemplary embodiment of the display device includes a pixel circuit with three thin film transistors shown, the display device may be changed to support different configurations of the pixel circuit.

The respective components are functionally classified, and may be assembled from individual integrated circuits (ICs) or be assembled from a single integral IC. This may depend on a manufacturer's design of a display panel.

The timing controller 100 may receive timing signals such as a vertical synchronization signal Vsync, a horizontal synchronization signal Hsync, a data enable signal DE, a clock signal CLK, first image data from an external host system and the like.

The timing controller 100 may generate a first control signal and second image data and supply the generated first control signal and second image data to the data driver 300, supply a second control signal to the driver 200, supply a third control signal to the emission controller 400, depending on the timing signals and the first image data.

The first control signal may include a source start pulse (SSP) indicating a starting point of 1 horizontal period (1H), a source sampling clock (SSC) controlling a data latch operation based on a rising edge or a falling edge, a source output enable signal (SOE) controlling an output of the data driver 300, and the like.

The second control signal may include a gate start pulse (GSP) indicating a start of each horizontal period configuring 1 vertical period in which one display frame is displayed, a gate shift clock (GSC) signal input to a shift register in the scan driver 200 to sequentially shift the gate start pulse, a gate output enable (GOE) signal controlling an output of the scan driver 200, and the like.

The third control signal may include a synchronization signal controlling supply timing of a light emission control signal supplied from the emission controller 400, and the like. The synchronization signal may be supplied in synchronization with the vertical synchronization signal Vsync and the horizontal synchronization signal Hsync.

The data driver 300 performs gamma correction depending on the first control signal and the second image data to generate data voltages, and supplies the data voltages to the respective pixels on a display panel through a plurality of data lines DATA.

The scan driver 200 supplies sequential scan pulses synchronized with the data voltages to pixel rows on the display panel through a plurality of scan lines SCAN, depending on the second control signal.

The emission controller 400 enables sequential light emission per pixel row depending on the third control signal.

Figure 2:
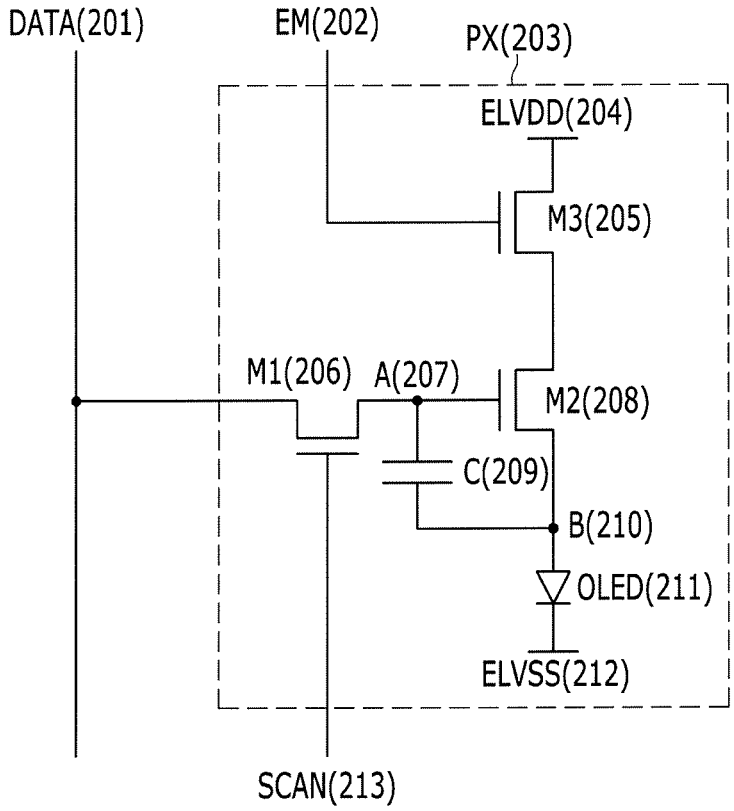
FIG. 2 [RELATED ART]
FIG. 2 is a view of a pixel circuit according to the related art.

FIG. 2 is a view showing a configuration of a pixel circuit according to the related art.

Referring to FIG. 2, a pixel circuit diagram according to the related art configured to include three transistors M1 206, M2 208, and M3 205 and one capacitor C 209 is shown.

The transistor M1 206 has a control terminal connected to a scan line SCAN 213, one end is connected to a data line DATA 201, and the other end is connected to a node A 207.

The transistor M2 208 has a control terminal connected to the node A 207, one end is connected to one end of the transistor M3 205, and the other end is connected to a node B 210.

The transistor M3 205 has a control terminal connected to a light emission control signal line EM 202, one end is connected to one end of the transistor M2 208, and the other end is connected to a first power supply ELVDD 204.

The capacitor C 209 has one end is connected to the node A 207 and the other end is connected to the node B 210.

An organic light emitting diode OLED 211 has an anode connected to the node B 210 and a cathode connected to a second power supply ELVSS 212.

A method of operating a pixel described in the pixel circuit diagram of FIG. 2 will be detailed below.

First, a data voltage is applied to the data line DATA 201, and an ON-level voltage is applied to the scan line SCAN 213. In this case, an OFF-level voltage is applied to the light emission control signal line EM 202.

The transistor M1 206 is conducted, and, the data voltage Vdata is applied to the node A 207. A voltage in which a threshold voltage value of the organic light emitting diode OLED 211 is applied to the node B 210, and the capacitor C 209 is charged with a voltage corresponding to a difference between a voltage of the node A 207 and a voltage of the node B 210 (data writing period).

Next, an OFF-level voltage is applied to the scan line SCAN 213, and an ON-level voltage is applied to the light emission control signal line EM 202.

In this embodiment, the transistor enters an ON-state M2 208 when the capacitor C 209 stores a charge. The transistor M2 208 begins to conduct a current and the organic light emitting diode OLED 211 emits light (light emitting period).

A specific bias stress is applied to the respective transistors M1 206, M2 208, and M3 205 while the data writing period and the light emitting period are repeated. This bias stress may be divided into a positive bias stress and a negative bias stress.

These bias stresses are determined depending on a polarity of a voltage applied on average to the respective transistors M1 206, M2 208, and M3 205.

Generally, the light emitting period is set to be longer than the data writing period. Therefore, the polarity of the voltage applied on average to the respective transistors M1 206, M2 208, and M3 205 may be a polarity of the voltage applied during the light emission period.

In addition, to determine whether the bias stress is the positive bias stress or the negative bias stress, a difference Vds between a drain voltage and a source voltage, a difference Vgs between a gate voltage and the source voltage, and the like, are considered. However, it may also be determined whether the bias stress is the positive bias stress or the negative bias stress by considering a polarity of a voltage applied on average to the gate electrode.

Although an N-channel transistor (N-channel metal oxide semiconductor (NMOS)) will be described below by way of example in the present invention, features of the present invention may also be applied to a P-channel transistor (P-channel metal oxide semiconductor (PMOS)) through the same process.

A type of bias stress of each of the transistors M1 260, M2 208, and M3 205 is decided.

The transistor M receives a voltage having a positive polarity on average from the data line DATA 201 through a drain electrode thereof. For example, a data voltage is applied to a corresponding pixel row or the data voltage is continuously applied to the drain electrodes in another pixel row.

The transistor M1 206 receives a voltage having a negative polarity on average from the scan line SCAN 213 at a gate electrode thereof. For example, the transistor M1 206 receives the voltage having the positive polarity, which is an ON-level, only during a data writing period of a corresponding pixel row. The transistor M1 206 receives the voltage having the negative polarity, which is an OFF-level, during a data writing period of another pixel row and the light emitting period.

Therefore, the transistor M1 206 is determined to be a negative bias stress type transistor.

A voltage applied to the drain electrode of transistor M2 208 is the voltage supplied from the first power supply ELVDD 204 less the voltage drop from transistor M2 205. The voltage applied to the source electrode of transistor M2 208 is the voltage supplied from the second power supply ELVSS 212 less the voltage applied to the organic light emitting diode OLED 211. Therefore, the voltage difference between the drain and the source Vds of the transistor M2 208 has a positive polarity on average.

A voltage between a gate electrode and the source electrode of the transistor M2 208 may be a difference between the data voltage and a voltage of the second power supply ELVSS 212. For example, Vgs of the transistor M2 208 is a voltage having a positive polarity on average.

Therefore, it may be decided that the transistor M2 208 is a positive bias stress type transistor.

A voltage between a drain electrode and a source electrode of the transistor M3 205 may be a difference between a voltage of the first power supply ELVDD 204 and the voltage of the second power supply ELVSS 212. For example, Vds of the transistor M3 205 is a voltage having a positive polarity on average.

A voltage between a gate electrode and the source electrode of the transistor M3 205 may be a difference between an ON-level voltage of the light emission control signal and the voltage of the second power supply ELVSS 212. For example, Vgs of the transistor M3 205 is a voltage having a positive polarity on average.

Therefore, it may be determined that the transistor M3 205 is a positive bias stress type transistor.

Only the bias stress types of three transistors M1 206, M2 208, and M3 205 have been determined because the pixel described in the pixel circuit diagram of FIG. 2 contains only three transistors M1 206, M2 208, and M3 205. Another embodiment of a pixel may include six transistors, seven transistors, eight transistors, or the like, and the type of bias stresses of the respective transistor may be determined. In addition, when a compensation circuit unit is added, the type of transistors included in the compensation circuit unit may be decided.

In addition to a method of determining the type of the bias stress described above, another determining method may also be used.

Figure 3:
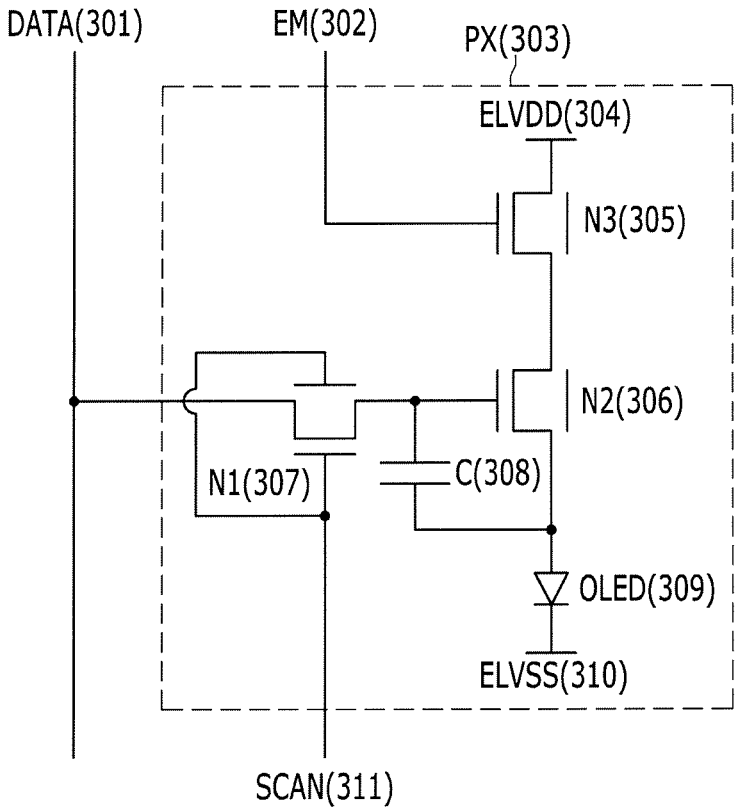
FIG. 3 is a view of a pixel circuit according to an exemplary embodiment of the present invention.
Figure 4:
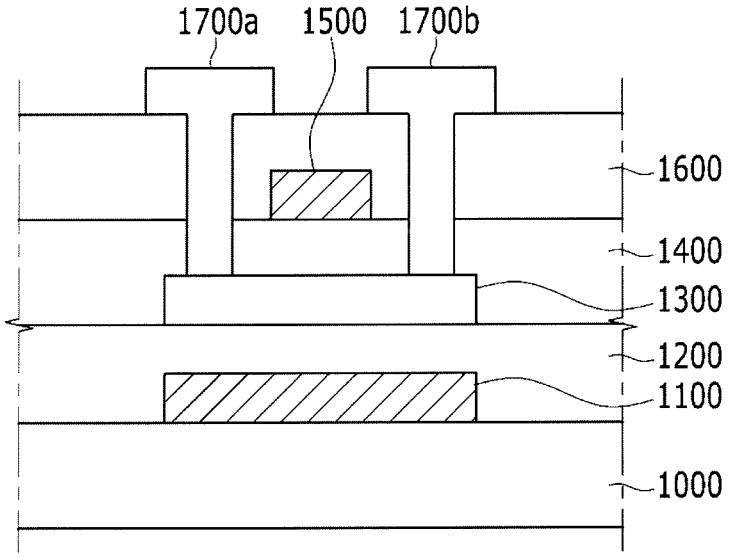
FIG. 4 is a view of an illustrative double-gate transistor according to an exemplary embodiment.

FIG. 3 is a view showing a configuration of a pixel circuit according to an exemplary embodiment of the present invention. In addition, FIG. 4 is a view showing an illustrative double-gate transistor.

In the pixel circuit of FIG. 3, the transistors M1 206, M2 208, and M3 205 included in the pixel circuit of FIG. 2 have been replaced by transistors N1 307, N2 306, and N3 305, respectively, depending on types of bias stresses. Since a driving method of the pixel circuit of FIG. 3 is the same as that of FIG. 2, a description therefor will be omitted.

In the present invention, positive bias stress type transistor M2 208 and M3 205 have been replaced by double-gate type transistors N2 306 and N3 305, respectively. Each of the transistors N2 306 and N3 305 includes a top gate and a bottom gate, but floats the bottom gate and uses the top gate as a control terminal.

In addition, a negative bias stress type transistor M1 206 has been replaced by a double-gate type transistor NI 307. The transistor N1 307 includes a top gate and a bottom gate, and uses the same node to which the top gate and the bottom gate are electrically connected as a control terminal.

In FIG. 4, a structure of the illustrative double-gate transistor is shown.

Referring to FIG. 4, the double-gate transistor is stacked on a substrate 1000, and includes a bottom gate electrode 1100, an active layer 1300, a top gate electrode 1500, a source electrode 1700*a*, a drain electrode 1700*b*, and other insulation layers 1200, 1400, and 1600.

In the present invention, transistors having the substantially similar structure as shown in FIG. 4 may be used as a positive bias stress type transistor and/ or a negative bias stress type transistor. However, as described above, there is a difference in whether the bottom gate is floated or is connected to the top gate.

FIG. 4 illustrates a transistor having a double-gate structure. Various types of transistors with double-gate structures may be used to implement the features of the present invention.

As shown in FIGS. 3 and 4, a kind of transistor is determined depending on whether the bias stress type is positive or negative. This allows a type of transistor to be selected that may decrease deterioration of the transistor in the use of the display device after manufacture.

For example, even though the transistor may deteriorate, a variation range of a threshold voltage value of the transistor is minimized, such that there is no problem in driving the display device.

In the present embodiment a pixel circuit of an organic light emitting display has been described by way of example. Since one or more transistors are also formed in a pixel circuit of a liquid crystal display, features of the present invention may also be applied to the liquid crystal display.

Figure 5:
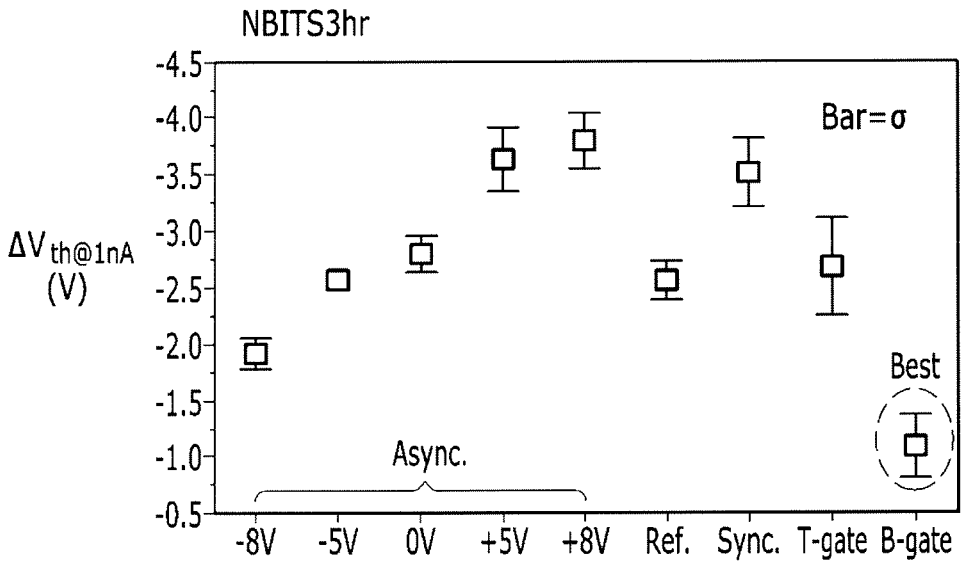
FIG. 5 is a view showing results of a negative bias illumination temperature stress (NBITS) test on various thin film transistors.
Figure 8:
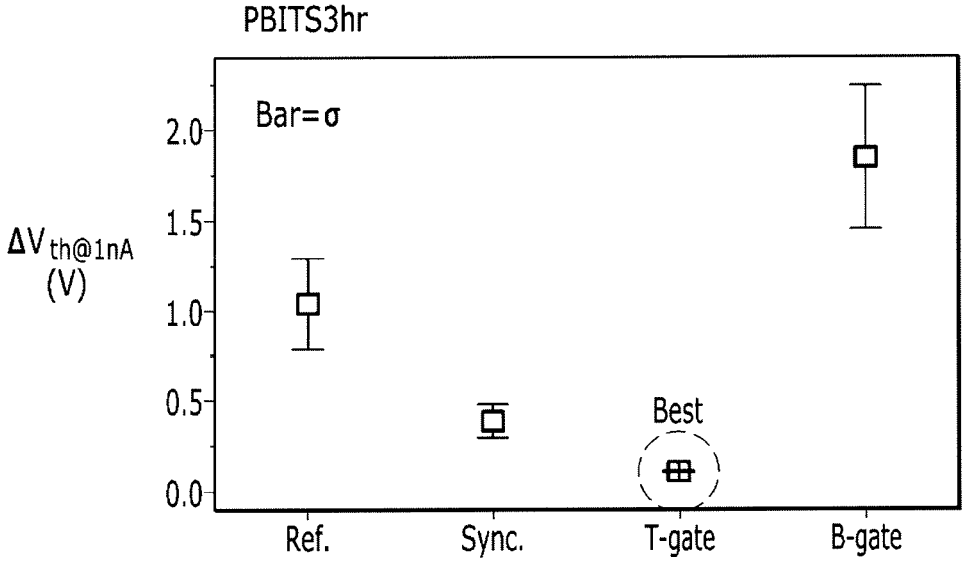
FIG. 8 is a view showing results of a positive bias illumination temperature stress (PBITS) test on various thin film transistors.

FIGS. 5 and 8 show experimental results for supporting an effect that a variation range of a threshold value of the transistor is decreased when the transistor having the above-mentioned configuration is adopted depending on the type of the bias stress described above.

FIG. 5 is a view for describing a result obtained by performing a negative bias illumination temperature stress (NBITS) test on multiple kinds of thin film transistors for three hours.

A horizontal axis indicates a kind of transistor used in an experiment, and a vertical axis indicates a variation degree of a threshold voltage Vth when a current of 1 lnA passes through the transistors.

A transistor represented by Async in the horizontal axis, which is a double-gate transistor, has different voltages applied to a top gate and a bottom gate, respectively. In the present experiment, a control signal was applied to the bottom gate used as a control electrode, and a fixed voltage was applied to the top gate. A range of the fixed voltage, which is −8V to +8V, is shown in the horizontal axis.

A transistor Ref has a bottom single-gate structure.

A transistor Sync, having a double-gate structure, has a top gate and a bottom gate connected to the same node, such that the same control signal is applied to the top gate and the bottom gate.

A transistor T-gate, having a double-gate structure, wherein a control signal is applied to a top gate and a bottom gate is floated.

A transistor B-gate, having a double-gate structure, has a control signal applied to a bottom gate and the top gate of the transistor B-gate is floated.

The experiment was repeated multiple times for each kind of transistor. Therefore, each kind of transistor has a standard deviation (σ) value of a variation in a threshold voltage. This standard variation value was shown as a length of a bar.

Referring to FIG. 5, it may be appreciated that since a variation in a threshold voltage of the transistor having the B-gate structure is the smallest in a NBITS experiment result, the B-gate structure is preferable.

Figure 6:
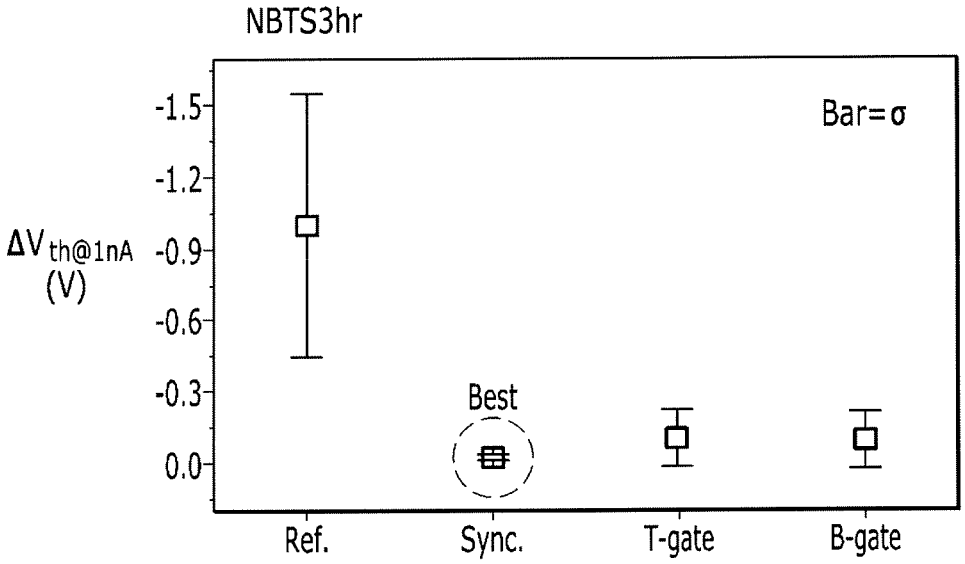
FIG. 6 is a view showing results of a negative bias temperature stress (NBTS) test on various thin film transistors.

FIG. 6 is a view for describing a result obtained by performing a negative bias temperature stress (NBTS) test on multiple kinds of thin film transistors for three hours.

Since a horizontal axis and a vertical axis are the same as those described with reference to FIG. 5, a description will be omitted.

In FIG. 6, transistors with the Sync structure have the smallest variation in threshold voltage. Therefore, a transistor having the Sync structure is preferable.

Referring to FIGS. 5 and 6, it may be appreciated that applying a negative bias stress on average to a transistor having the B-gate structure or the Sync structure results in a variation in a threshold voltage is minimized. Therefore, the B-gate structure or the Sync structure may be selected depending on an environment in which the transistor is used.

In FIG. 3 of the present invention, the transistor N1 307 having the Sync structure was used. A threshold voltage of the transistor having the Sync structure is higher than that of the transistor having the B-gate structure. Therefore, it is easier to turn off the transistor having the Sync structure than to turn off the transistor having the B-gate structure, and a leakage current of the transistor having the Sync structure is smaller than that of the transistor having the B-gate structure during a turn-off period. Additionally, the energy required to actually drive the transistor having the Sync structure is less than in the transistor having the B-gate structure because it simultaneously uses the top gate and the bottom gate as a control terminal, even though the transistor having the Sync structure has a threshold voltage higher than that of the transistor having the B-gate structure.

Figure 7:
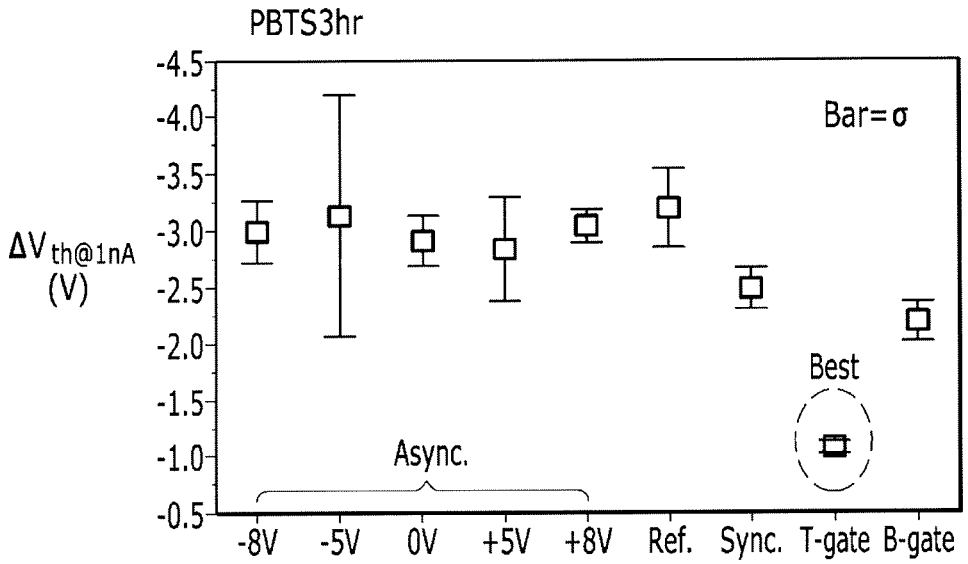
FIG. 7 is a view showing results of a positive bias temperature stress (PBTS) test on various thin film transistors.

FIG. 7 is a view for describing a result obtained by performing a positive bias temperature stress (PBTS) test on multiple kinds of thin film transistors for three hours. In addition, FIG. 8 is a view for describing a result obtained by performing a positive bias illumination temperature stress (PBITS) test on multiple kinds of thin film transistors for three hours.

Since a horizontal axis and a vertical axis of FIGS. 7 and 8 are the same as those described with reference to FIG. 5, a description will be omitted.

Referring to FIGS. 7 and 8, it may be appreciated that when a positive bias stress is applied on average to a transistor with the T-gate structure a variation in a threshold voltage is minimized. Therefore, in FIG. 3 of the present invention, the transistors N2 306 and N3 305 having the T-gate structure were used.

The accompanying drawings and the detailed description have not been used in order to limit the meaning or limit the scope of the present invention stated in the claims, but have been used only in order to illustrate the present invention. Therefore, it will be understood by those skilled in the art that various modifications and other equivalent exemplary embodiments may be made from the present invention. Therefore, an actual technical protection scope of the present invention is to be defined by the claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a plurality of pixels, wherein each of the plurality of pixels includes at least two double-gate transistors, each double-gate transistor including a first gate electrode and a second gate electrode;

wherein each double-gate transistor is configured to conduct a current between a source electrode thereof and a drain electrode thereof when a voltage is applied to the first gate electrode thereof, a type of electrical connection of the second gate electrode of each of the at least two double-gate transistors is selected depending on a polarity of a voltage applied on average to each of the at least two double-gate transistors, the type of electrical of the second gate electrode is one of a first electrical connection that is floated or a second electrical connection where the first gate electrode and the second gate electrode are connected, and the type of electrical connection of the second gate electrode is the first connection when the polarity of the voltage applied on average to each of the at least two double-gate transistors is a positive polarity, and is the second connection when the polarity of the voltage applied on average to each of the at least two double-gate transistors is a negative polarity.

2. The display device of claim 1, wherein:

the polarity of the voltage applied on average to each of the at least two double-gate transistors is a polarity of a voltage applied during a light emitting period in which a light emitting unit of each of the plurality of pixels emits light.

3. The display device of claim 1, wherein:

the polarity of the voltage applied on average to each of the at least two double-gate transistors is a polarity of a voltage applied on average to the first gate electrode of each of the at least two double-gate transistors.

4. The display device of claim 1, wherein:

the polarity of the voltage applied on average to each of the at least two double-gate transistors is a difference between a voltage applied on average to the first gate electrode thereof and a voltage applied on average to the source electrode thereof when the at least two double-gate transistors are N-channel transistors.

5. The display device of claim 1, wherein:

the first gate electrode is a top gate electrode, and the second gate electrode is a bottom gate electrode.

6. The display device of claim 5, thither comprising:

a data driver supplying a corresponding data voltage to each of the plurality of pixels; and a scan driver supplying a corresponding scan voltage to each of the plurality of pixels, wherein a switching transistor having the scan voltage applied to the first gate electrode thereof and the data voltage applied to the drain electrode thereof is in the second connection, and a driving transistor having a voltage applied to the first gate electrode thereof and corresponding to the data voltage is in the first connection.

7. The display device of claim 6, further comprising:

an emission controller supplying a corresponding light emission control signal to each of the plurality of pixels, wherein a light emission control transistor having the light emission control signal applied to the first gate electrode thereof and having a first power supply connected to one end thereof is in the first connection.

8. A plurality of pixels in a display device comprising:

at least a first transistor and a second transistor;

wherein the first transistor and the second transistor are connected in series between a first power supply voltage and an organic light emitting diode (OLED), wherein the first transistor is a double-gate transistor and the second transistor is a double-gate transistor, a first gate electrode of the first transistor is connected to a light emission control signal line, a first gate electrode of the second transistor is connected to a third transistor and a capacitor, an electrical connection between the first gate electrode and the second electrode of each of the at least two double-gate transistors in each pixel depends on a polarity of a voltage applied on average to each of the at least two double-gate transistors, and a second gate electrode of the first transistor is floated and a second gate electrode of the second transistor is floated when the polarity of the voltage applied on average to each of the at least two double-gate transistors is a positive polarity.

9. The plurality of pixels of claim 8, wherein:

the third transistor is a double-gate transistor; and one end of the third transistor is electrically connected to a data line and a first gate of the third transistor is electrically connected to a scan line and the second gate of the third transistor is also electrically connected to the scan line.

10. The plurality of pixels of claim 8, wherein:

the first gate electrode is a top gate electrode, and the second gate electrode is a bottom gate electrode of each double-gate transistor.

11. The plurality of pixels of claim 8, further comprising:

a data driver supplying a corresponding data voltage to each of the plurality of pixels; and a scan driver supplying a corresponding scan voltage to each of the plurality of pixels, wherein a switching transistor having the scan voltage applied to the first gate electrode thereof and the data voltage applied to the drain electrode thereof is in a second connection, and a driving transistor having a voltage applied to the first gate electrode thereof and corresponding to the data voltage is in a first connection.

12. The plurality of pixels of claim 11, further comprising:

an emission controller supplying a corresponding light emission control signal to each of the plurality of pixels, wherein a light emission control transistor having the light emission control signal applied to the first gate electrode thereof and having a first power supply connected to one end thereof is in the first connection.

13. The plurality of pixels of claim 8, wherein:

a kind of transistor for use in each pixel is selected depending on whether a bias stress type is positive or negative.

14. The plurality of pixels of claim 13, wherein:

in order to ascertain whether the bias stress is the positive or the negative, a difference Vds between a drain voltage and a source voltage and a difference Vgs between a gate voltage and the source voltage are considered.

15. The plurality of pixels of claim 13, wherein:

in order to ascertain whether the bias stress is positive or negative the polarity of a voltage applied on average to the gate electrodes of each transistor are considered.

* * * * *